US006942176B2

(12) United States Patent
Scott

(10) Patent No.: US 6,942,176 B2
(45) Date of Patent: Sep. 13, 2005

(54) RIBBON SUPPLY SPOOL

(75) Inventor: Michael Scott, Blythewood, SC (US)

(73) Assignee: MicrRibbons L.L.C., Blythewood, SC (US)

( * ) Notice: Subject to any disclaimer, the term of this patent is extended or adjusted under 35 U.S.C. 154(b) by 351 days.

(21) Appl. No.: 10/197,012

(22) Filed: Jul. 16, 2002

(65) Prior Publication Data

US 2004/0011913 A1 Jan. 22, 2004

(51) Int. Cl.[7] ..... B65H 16/02

(52) U.S. Cl. ..... 242/612; 242/611.1; 242/538.2

(58) Field of Search ..... 242/611, 611.1, 242/612

(56) References Cited

U.S. PATENT DOCUMENTS 5,374,007 A * 12/1994 Murison ..... 242/538.2

* cited by examiner

*Primary Examiner*—Kathy Matecki
*Assistant Examiner*—Evan H Langdon
(74) *Attorney, Agent, or Firm*—Perman & Green, LLP

(57) ABSTRACT

A printer ribbon spool comprising an integral element, molded in one piece from a durable plastic composition, such as of nylon, has an elongate cylindrical ribbon support shaft of substantially uniform, relatively small diameter. One end of the support shaft functions as a first rotation bearing member for the spool, and the other end of the shaft is integral with a narrow, relatively large diameter gear having on the opposed surface thereof a second cylindrical rotation bearing member having a larger diameter than the diameter of the ribbon support shaft and of the first rotation bearing portion thereof.

4 Claims, 2 Drawing Sheets

RIBBON SUPPLY SPOOL

BACKGROUND OF THE INVENTION

1. Field of the Invention

Figure 1:
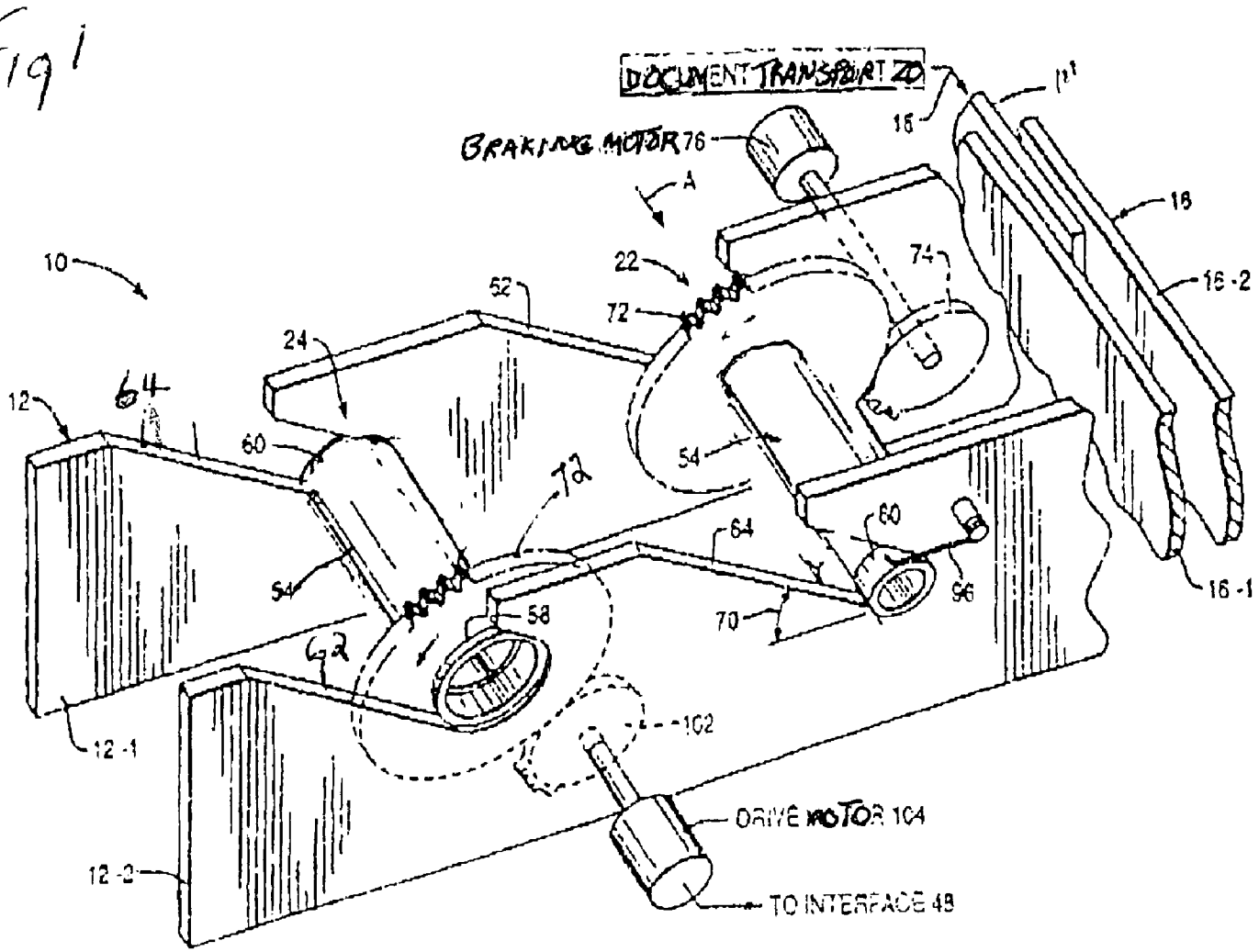

This invention relates to a ribbon supply spool for an apparatus for feeding ribbon to a print station and is directed to features which enable the ribbon supply spool and ribbon take-up spool to be simpler to make and use, and to contain an increased length of ribbon.

2. Background Information

A first general problem with handling ink ribbons is that they are dirty to handle when the ribbon is to be changed frequently for a printer, for example. A second problem with ribbons relates to those which first must be mounted on a core. Such cores have an axial bore or passage and are designed to be assembled over and keyed to the supply shaft and to carry a length of the ribbon. The core must be sufficiently thick radially so as to have the necessary strength and dimensional stability to resist warping or contraction so that the axial bore or passage retains an inner diameter which enables it to be slipped over the outer diameter surface of the shaft of the supply spool during assembly.

STATE OF THE ART

It is known in U.S. Pat. No. 5,374,007 to provide a two-piece ribbon supply/take-up spool having a molded tubular, ribbon-carrying core member and a molded hollow shaft member onto which the core member is designed to be mounted and locked against relative rotation. The molded core member has a central bore containing an annular slot or recess which receives a detent member on the outer surface of the shaft member, and also contains a plurality of teeth which mesh with a plurality of teeth on the outer surface of the shaft member to prevent relative rotation of the core member and the shaft member.

The need for molding the two pieces, namely the tubular core member and the hollow shaft member, with the annular slot, detent member and the cooperating engagement teeth, substantially increases the cost of the ribbon supply/take-up spool. Moreover, the necessary radial thickness of the tubular core, coupled with the diameter of the hollow shaft member, substantially reduces or limits the diameter of the ribbon which can be wound thereon, and the length thereof, to preclude interference of the wound ribbon with elements of the printer apparatus such as the dancer arm, ribbon driving gears and other elements which may be present, depending upon the particular printing apparatus used.

SUMMARY OF THE INVENTION

The present invention provides a novel, one-piece or unitary ribbon supply/take-up spool for a printing apparatus, such as disclosed in U.S. Pat. No. 5,374,007 and similar apparatuses, which is relatively simple and inexpensive to produce, which avoids the need for and disadvantages of separate ribbon-supporting cores and for any means for preventing relative rotation between the mounted ribbon and the ribbon-support shaft, and which enables the winding thereon of a substantially increased length of printing ribbon without any interference with the frame of the apparatus or with the dancer arm or other elements of the particular apparatus, and without extending beyond the diameter of the large gear of the ribbon spool which functions as a driving gear when the spool is positioned as a supply spool and functions as a braking gear when the spool is positioned as a take-up spool.

The present ribbon spool is an integral element, molded in one piece from a durable plastic composition, such as of nylon, comprising an elongate cylindrical ribbon support shaft of substantially uniform, relatively small diameter. One end of the support shaft functions as a first rotation bearing member for the spool, and the other end thereof is integral with a narrow, relatively large diameter gear having on the opposed surface thereof a second cylindrical rotation bearing member having a larger diameter than the diameter of the ribbon support shaft and of the first rotation bearing portion thereof.

THE DRAWINGS

Figure 2:
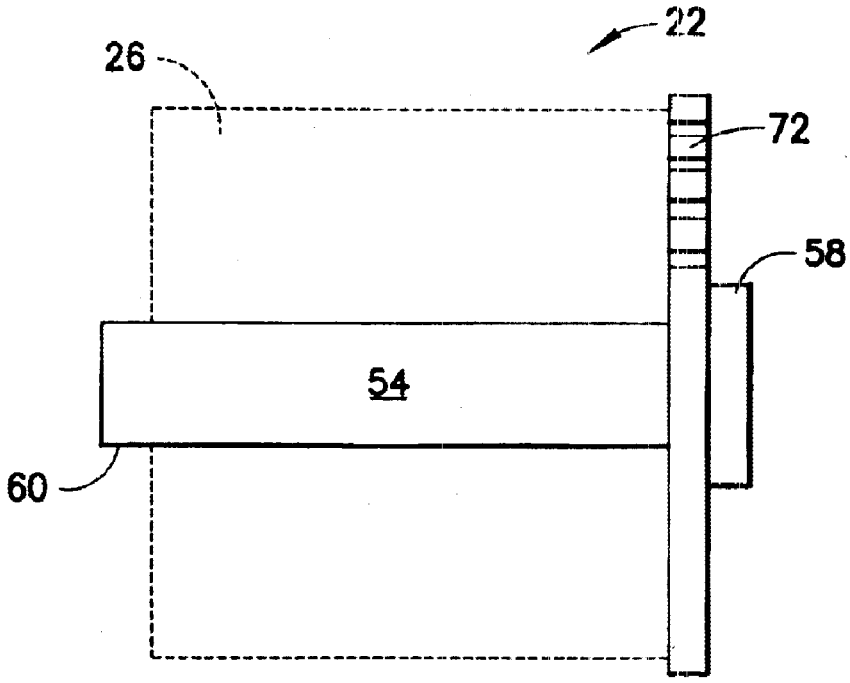
Figure 3:
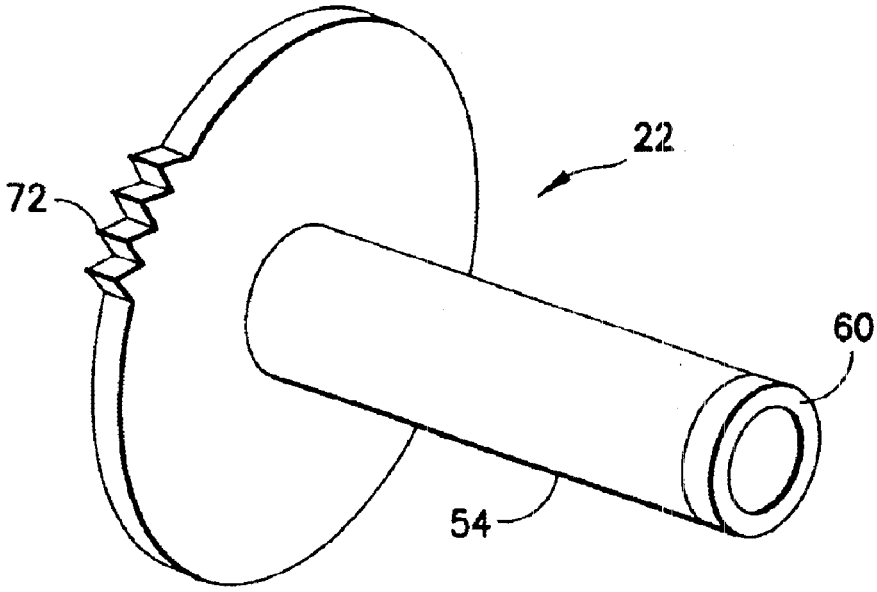

FIG. 1 is an isometric view of a printing apparatus containing the novel ribbon spools of the present invention, one installed and oriented as a ribbon-supply spool and a second installed and oriented as a ribbon take-up spool, both shown without the presence of wound ribbon for purposes of illustration, and FIG. 2 is side view of the integral ribbon spool of the present invention, and FIG. 3 is an isometric view of the ribbon supply spool of FIG. 2, without the ribbon.

DETAILED DESCRIPTION

FIG. 1 shows a ribbon supply printing apparatus which is designated generally as apparatus 10 and which accommodates the novel ribbon supply and take-up spools of the present invention. The apparatus 10 includes a support 12 which includes first and second side frames 12-1 and 12-2. The apparatus 10 may be used in a business machine such as an encoder which is used to print or encode data on a document 14. The document 14 is moved in a document track 16, in a downstream direction, as shown by the direction of arrow 18, by a document transport 20, as is done conventionally. The document track 16 has upstanding side walls 16-1 and 16-2 and a track bottom.

The apparatus 10 includes a ribbon supply spool 22 and a ribbon take-up spool 24. Ribbon from the supply spool 22 is fed to the print station where a printer is used to print data on the document 14, such as in the form of magnetically-readable images. In the embodiment described, the printer selected to portray the invention includes a type drum and a plurality of hammers, although other types of printers, such as thermal printers, could be used. The type drum includes a plurality of type wheels, with one hammer being provided for each type wheel included in the type drum. The upstanding sides 16-1 and 16-2 have suitable openings therein to enable the hammers to impact the document 14 and the ribbon against the type drum as is conventionally done. There are the usual motor timing circuits to control the data which is printed on the document 14, as disclosed in U.S. Pat. No. 5,374,007.

The ribbon supply/take-up spool 22, is shown in more detail in FIGS. 2 and 3.

The ribbon spool 22 has a generally cylindrical elongate shaft member 54 which has a large bearing or support portion 58 at one end thereof and a small bearing or support portion 60 at the remaining end thereof, as shown best in FIG. 2. The first side frame 12-1 has a first slot or wide slot 62 (FIG. 1) to receive and rotatably support the large bearing portion 58 and also has a second or narrow slot 64 to receive and rotatably-support the small bearing portion 60. This construction ensures that the ribbon supply spool 22 is loaded correctly in the support 12. The first and second side frames 12-1 and 12-2 are spaced apart so as to enable a ribbon 26 on the ribbon supply spool 22 to abut the first side frame 12-1 and to abut the second side frame 12-2 so as to restrain the ribbon supply spool 22 against axial movement within the support 12. The first and second bearing slots 62 and 64 are positioned at an angle of 60 degrees relative to a horizontal line (as shown by double arrow 70 in FIG. 1); this type of construction enables the ribbon supply spool 22, with a supply of ribbon 26 thereon, to be expended to its operating position shown in FIG. 1 without interfering with other elements in the machine in which the apparatus 10 is located. The fresh ribbon 26 which is used in the apparatus 10 is wound on the supply spool shaft 54 when received at the apparatus 10.

The ribbon supply spool 22, shown in FIGS. 1 to 3, has an external gear 72 located adjacent one end of shaft 54. When the ribbon supply spool 22 is in the operating position shown in FIG. 1, the external gear 72 meshes with a braking gear 74. The braking gear 74 is coupled to a braking motor 76, which is controlled by the controller, as will be described hereinafter. Essentially, the breaking gear 74 and the braking motor 76 keep the ribbon supply spool 22 from rotating.

Naturally, the bottoms of the bearing slots 62 and 64, shown in FIG. 1, are arcuately shaped to rotatably support the large bearing portion 58 and the small bearing portion 60 and to maintain the longitudinal axis of the ribbon supply spool 22 in a horizontal position in the embodiment described. The ribbon supply spool 22, with a supply of ribbon thereon, is maintained in the position shown in FIG. 1 by gravity and a spring clip which is shown, schematically, as a spring loaded wire 96. The wire 96 biases the ribbon supply spool 22 in a downward direction, as viewed in FIG. 1. The wire 96 contacts the bearing portion 60 of the ribbon supply spool 22. There is a similar spring loaded wire 96 (not shown) contacting the support portion 58 of the ribbon supply spool 22. The ribbon take-up spool 24 has similar spring loaded wires (not shown) at support portions 58 and 60.

While this discussion has proceeded with respect to the ribbon supply spool 22, the ribbon take-up spool 24 is identical to the ribbon supply spool 22; consequently, a detailed discussion of the take-up spool 24 is not deemed necessary. An important difference relates to the way that the ribbon take-up spool 24 is oriented and positioned in the support 12. In this regard, the large bearing portion 58 of the take-up spool 24 is mounted in a slot in the second side frame 12-2 and the small bearing portion 60 is mounted in a slot in the side frame 12-1, as shown in FIG. 1. The external gear 72 of the take-up spool 24 is in mesh with a driving gear 102 which is rotated by a drive motor 104 which is controlled by a controller (not shown). The external gears 72 of the ribbon supply spool 22 and the ribbon take-up spool 24 are located on opposed sides of the support 12 when properly oriented and positioned in the support 12 as shown in FIG. 1.

The ribbon 26 is wound on the tubular core member 54 so that the ribbon 26 is drawn or dispensed from the ribbon supply spool 22 in the proper direction. The ribbon 26 rides over rollers at the print station to provide some clearance for the type drum to rotate without contacting the ribbon 26 until actual printing takes place by energizing the print hammers. An idler roller is used to route the ribbon 26 from the print station to a metering roller, and thereafter, the ribbon 26 is wound or collected on the shaft 54 of the take-up spool 24. The general function of the metering roller is to cooperate with the drive motor 104 to ensure that a prescribed amount of ribbon 26 is supplied to the print station for each cycle of printing which is effected. Because this aspect is not important to an understanding of this invention, it need not be discussed in any further detail.

The overall operation of the ribbon supply printing apparatus 10 is as follows. The apparatus 10 includes a dancer arm (not shown) which has one end pivotally mounted in the support 12 and the remaining end thereof pivotally supporting a roller. The roller has an axial length which supports the entire width of the ribbon 26. When a fresh supply of ribbon 26 is to be supplied to the print station, the controller, through its associated software will "unlock" the braking motor 76, permitting the dancer arm to be pivoted in a clockwise direction to unwind some ribbon 26 from the ribbon supply spool 22. As the dancer arm pivots in a clockwise direction it approaches a positional sensor which is coupled to the controller via the interfaces, and the controller actuates the braking motor 76 which prevents further rotation of the ribbon supply spool 22. Thereafter, the controller energizes the drive motor 104 to feed the necessary amount of ribbon 26 to the print station as required by the printing demands. As the ribbon 26 is fed to the print station, the dancer arm pivots in a counterclockwise direction against the bias of the tension spring until the dancer arm approaches a positional sensor which is coupled to the controller via the interfaces. The controller then deenergizes the braking motor 76, permitting the tension spring to withdraw a new length of ribbon as described. The disclosure of U.S. Pat. No. 5,374,004 is incorporated herein with respect to the printing apparatus 10 and its elements and operation.

When the ribbon 26 from the supply spool 22 is exhausted, the supply spool 22 is removed from the position shown in FIG. 1. A new supply spool 22 with a new supply of ribbon thereon, is inserted. The used ribbon 26 is then removed from the ribbon take-up spool 24 and discarded, and a new "empty" ribbon supply spool 22 is then mounted as the ribbon take-up spool 24, in the apparatus 10.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An integral, one-piece printer ribbon spool comprising an elongate cylindrical ribbon support shaft of substantially uniform diameter, having directly wound thereon a length of a printing ribbon, one end of said ribbon support shaft comprising a first rotation bearing member and the other end thereof which is integral with a narrow gear having a larger diameter than said support shaft and having on the opposed surface thereof a second cylindrical rotation bearing member having a diameter larger than that of said first rotation bearing member.

2. A printer ribbon spool according to claim 1 molded of a single durable plastic composition.

3. A printer ribbon spool according to claim 2 in which the plastic composition comprises nylon.

4. A printer ribbon spool according to claim 1 in which the printing ribbon is one which prints magnetically-readable images.

* * * * *